US008827399B2

(12) United States Patent
Mochizuki

(10) Patent No.: US 8,827,399 B2
(45) Date of Patent: Sep. 9, 2014

(54) INKJET RECORDING APPARATUS AND INKJET RECORDING METHOD

(75) Inventor: Yoshiaki Mochizuki, Fuji (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 70 days.

(21) Appl. No.: 13/450,683

(22) Filed: Apr. 19, 2012

(65) Prior Publication Data

US 2012/0327149 A1 Dec. 27, 2012

(30) Foreign Application Priority Data

Jun. 21, 2011 (JP) ..... 2011-137785

(51) Int. Cl.
*B41J 29/38* (2006.01)
*B41J 2/045* (2006.01)
*B41J 2/14* (2006.01)

(52) U.S. Cl.
CPC .... *B41J 2/04516* (2013.01); *B41J 2002/14475* (2013.01); *B41J 2/04596* (2013.01); *B41J 2/04581* (2013.01); *B41J 2/14209* (2013.01); *B41J 2/04588* (2013.01)
USPC ..... 347/10; 347/5; 347/9; 347/11

(58) Field of Classification Search
CPC ..... B41J 29/38; B41J 2/01
See application file for complete search history.

(56) References Cited

U.S. PATENT DOCUMENTS 7,168,780 B2 1/2007 Mochizuki
7,490,920 B2 * 2/2009 Usuda ..... 347/23
2005/0177343 A1 * 8/2005 Nagae ..... 702/183
2006/0238553 A1 * 10/2006 Moriyama et al. ..... 347/10
2009/0293871 A1 * 12/2009 Kitakami ..... 128/203.12

FOREIGN PATENT DOCUMENTS

JP 2001-301161 10/2001
JP 2009-066867 4/2009
JP 2009066867 * 4/2009 ..... B41J 2/45
JP 2009-286047 12/2009
JP 2011-005688 1/2011
JP 2011005688 * 1/2011 ..... B41J 2/45
JP 2011-031441 2/2011

OTHER PUBLICATIONS

First Office Action of Reason for Rejection for Japanese Patent Application No. 2011-137785 Dated Jul. 23, 2013, 5 pgs.
Japanese Office Action for Japanese Application No. 2011-137785 mailed Mar. 11, 2014.

* cited by examiner

*Primary Examiner* — Manish S Shah
*Assistant Examiner* — Jeremy Delozier
(74) *Attorney, Agent, or Firm* — Amin, Turocy & Watson, LLP

(57) ABSTRACT

According to one embodiment, an inkjet recording apparatus includes a head body, electrodes, a nozzle plate and a control section. The control section is electrically connected to the electrodes and applies an ejection pulse or a non-ejection pulse to the electrodes. The ejection pulse includes a first voltage change process for increasing the volume of a pressure chamber and a second voltage change process for reducing the volume of the pressure chamber, has width equal to or larger than 0.95 times and equal to or smaller than 1.05 times of a pressure propagation time in the pressure chamber, and ejects the ink from a nozzle. The non-ejection pulse has width equal to or larger than 0.2 times and equal to or smaller than 0.34 times of the width of the ejection pulse and stops the ink in the nozzle.

14 Claims, 9 Drawing Sheets

INKJET RECORDING APPARATUS AND INKJET RECORDING METHOD

CROSS-REFERENCE TO RELATED APPLICATIONS

This application is based upon and claims the benefit of priority from the prior Japanese Patent Application No. 2011-137785, filed on Jun. 21, 2011, the entire contents of which are incorporated herein by reference.

FIELD

Embodiments described herein relate generally to an inkjet recording apparatus and an inkjet recording method.

BACKGROUND

As a recording system for performing gradation recording using an inkjet head, a multi-drop system is known. In the multi-drop system, ink droplets are ejected from the inkjet head to a predetermined position plural times to print a dot having predetermined density on a medium such as a recording sheet. For example, if a black dot having eight gradations is formed, seven black ink droplets are ejected from the inkjet head. Ink droplets are ejected in a number corresponding to a gradation level, for example, six ink droplets are ejected in the case of seven gradations and five ink droplets are ejected in the case of six gradations. If a white dot is formed, no ink droplet is ejected from the inkjet head (one gradation). If a gray dot is formed, one to three ink droplets are ejected from the inkjet heads to the same position. In this way, the number of times ink droplets are ejected from the inkjet head is selectively changed to print a high-quality image.

In the inkjet head of the multi-drop system, depending on a type of ink and setting conditions, a satellite drop occurs after plural ink droplets (hereinafter referred to as main drops) are ejected. The satellite drop is a small ink droplet formed when the main drops are ejected from a nozzle of the inkjet head.

The plural main drops and the satellite drop are dripped to a predetermined position, whereby dots are formed on the medium. It is likely that a small dot is formed by the satellite drop (hereinafter referred to as satellite dot) near a dot formed by the plural main drops (hereinafter referred to as main dot).

DETAILED DESCRIPTION

In general, according to one embodiment, an inkjet recording apparatus includes a head body, plural electrodes, a nozzle plate and a control section. The head body includes plural pressure chambers to which ink is supplied and a piezoelectric member that is deformed according to an applied voltage to change volume of each of the plural pressure chambers. The electrodes are provided in the piezoelectric member to respectively correspond to the plural pressure chambers. The nozzle plate is arranged to close the plural pressure chambers. Plural nozzles are respectively opened in the plural pressure chambers and provided in the nozzle plate. The control section is electrically connected to the plural electrodes, the control section applying, to the electrode corresponding to each of the pressure chambers, an ejection pulse or a non-ejection pulse. The ejection pulse includes a first voltage change process for applying a voltage for increasing the volume of the pressure chamber and a second voltage change process for applying a voltage for reducing the volume of the pressure chamber, has width equal to or larger than 0.95 times and equal to or smaller than 1.05 times of a pressure propagation time in the pressure chamber, and ejects the ink from the nozzle. The non-ejection pulse has width equal to or larger than 0.2 times and equal to or smaller than 0.34 times of the width of the ejection pulse and stops the ink in the nozzle.

Figure 1:
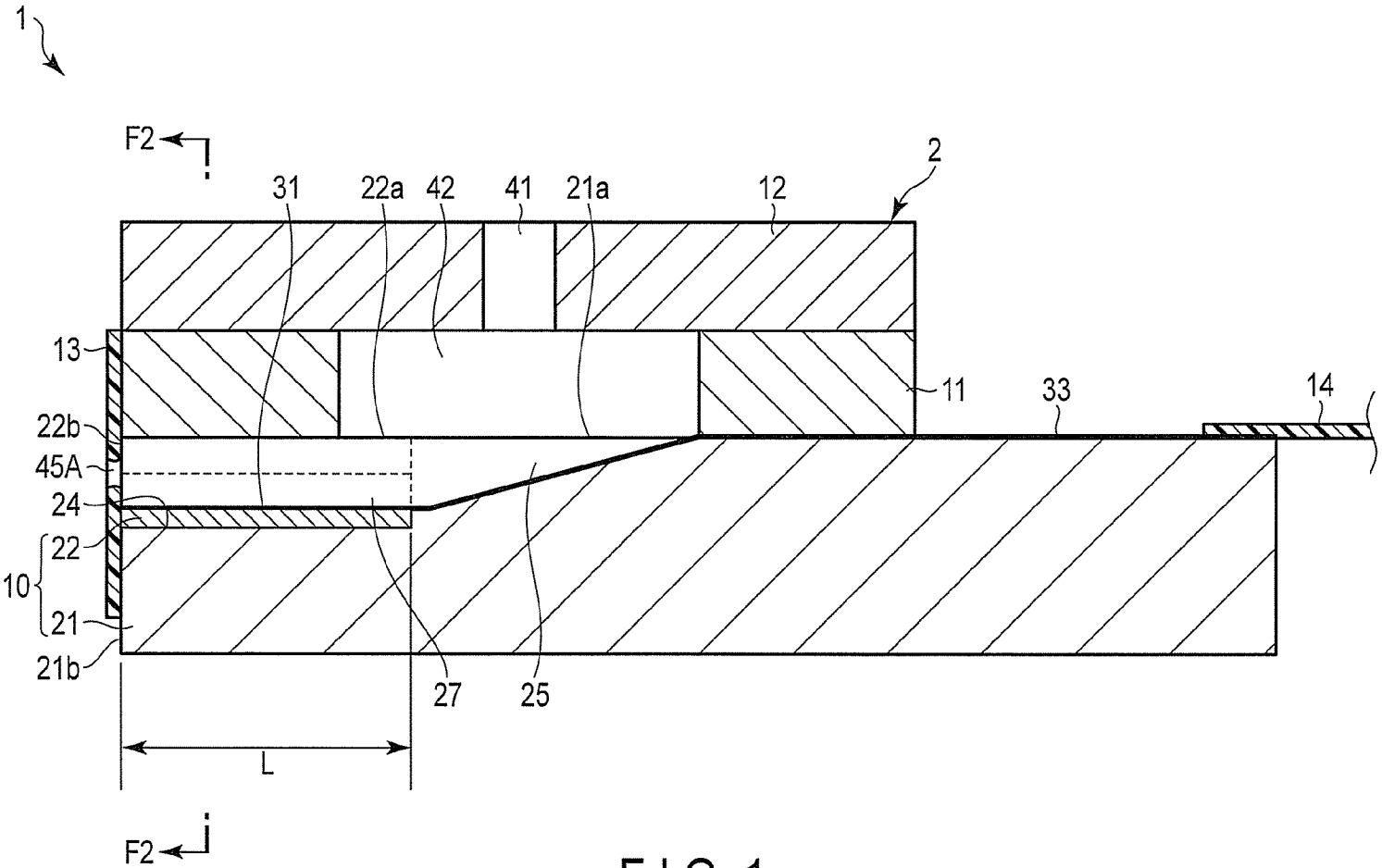
FIG. 1 is a sectional view of an inkjet head according to a first embodiment.

A first embodiment is explained below with reference to FIGS. 1 to 11. FIG. 1 is a sectional view of an inkjet head 2 of an inkjet recording apparatus 1.

Figure 2:
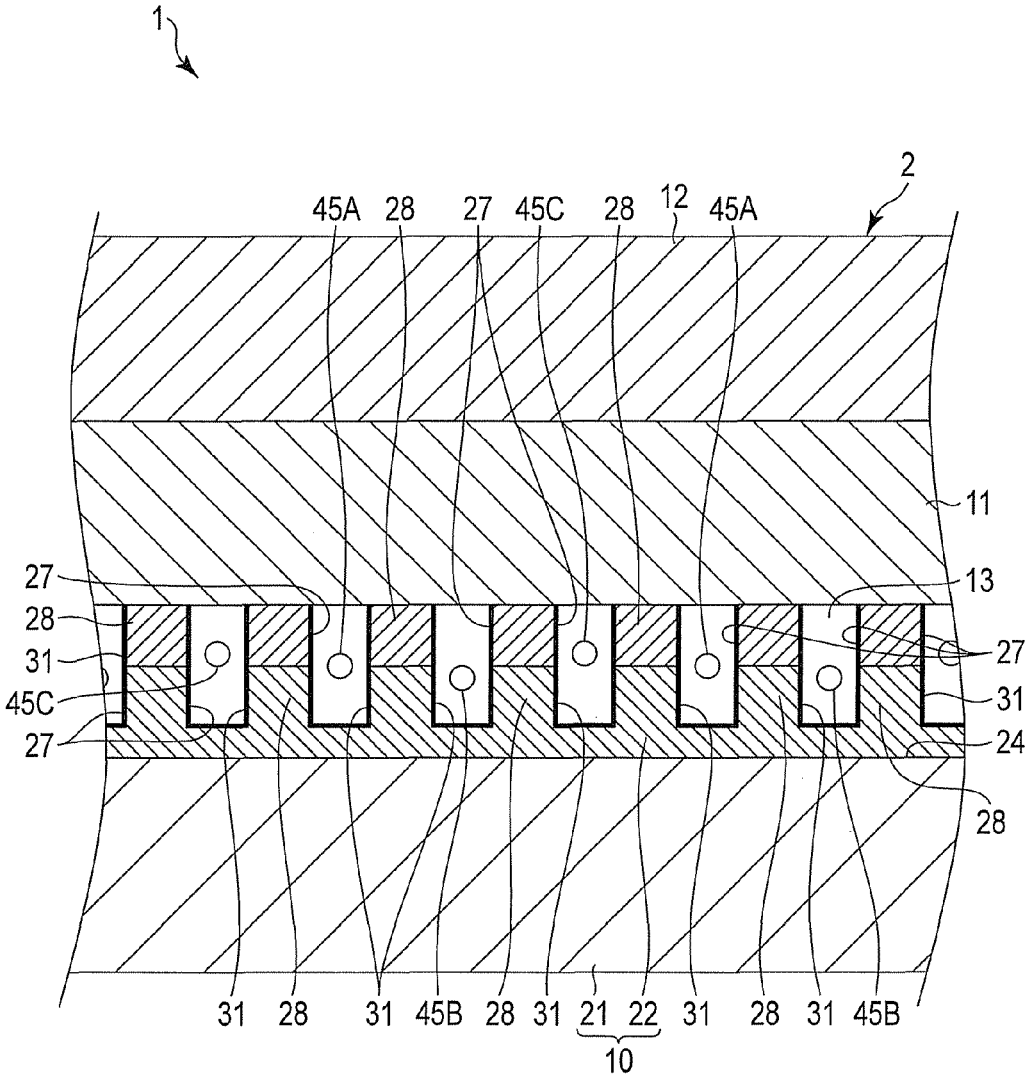
FIG. 2 is a sectional view of the inkjet head taken along line F2-F2 shown in FIG. 1.

FIG. 2 is a sectional view of a part of the inkjet head 2 taken along line F2-F2 shown in FIG. 1.

The inkjet recording apparatus 1 is, for example, an inkjet printer that performs printing on a medium such as a recording sheet using ink. The inkjet recording apparatus 1 includes the inkjet head 2 and other various components.

As shown in FIG. 1, the inkjet head 2 according to the first embodiment is an inkjet head of a shear mode type. The inkjet head 2 includes a head body 10, a frame member 11, a lid member 12, a nozzle plate 13, and a circuit board 14.

The head body 10 includes a base material 21 and a piezoelectric member 22. The base material 21 is formed in a rectangular tabular shape. A cutout section 24 and plural grooves 25 are provided in the base material 21. The cutout section 24 is provided to extend from an upper surface 21*a* to a front surface 21*b* of the base material 21. The plural grooves 25 are provided in parallel to one another. Each of the plural grooves 25 is opened on the upper surface 21*a* of the base material 21 and in the cutout section 24.

The piezoelectric member 22 is formed by, for example, sticking together two piezoelectric plates made of lead zirconate titanate (PZT). Polarization directions of the two piezoelectric plates are opposite to each other. The piezoelectric member 22 is deformed by a voltage applied thereto. The piezoelectric member 22 is attached to the cutout section 24 of the base material 21.

Plural pressure chambers 27 are provided in the piezoelectric member 22. Each of the plural pressure chambers 27 is formed in a groove shape. The plural pressure chambers 27 are provided in parallel to one another. The plural pressure chambers 27 respectively continue to the plural grooves 25 of the base material 21. The pressure chamber 27 is opened on an upper surface 22*a* and a front surface 22*b* of the piezoelectric member 22. The width of the pressure chamber 27 is, for example, 85 μm. The depth of the pressure chamber 27 is, for example, 300 μm. The length of the pressure chamber 27 is, for example, 1 mm.

As shown in FIG. 2, column sections 28 are respectively formed among the plural pressure chambers 27. The plural column sections 28 partition the plural pressure chambers 27 and form side surfaces of the pressure chambers 27. The width of the column sections 28 is, for example, 84 μm.

Each of plural electrodes 31 is provided in the piezoelectric member 22 and the base material 21. In FIGS. 1 and 2, the electrode 31 is indicated by a thick line. The plural electrodes 31 respectively cover the side surfaces and the bottom surfaces of the plural pressure chambers 27. The plural electrodes 31 continue from the pressure chambers 27 to the grooves 25. The electrode 31 is formed of, for example, a nickel thin film. The electrode 31 is not limited to the nickel thin film and may be formed of, for example, gold or copper. Since the electrodes 31 are formed on both the side surfaces of the column section 28, the column section 28 is used as a driving device.

As indicated by a thick line in FIG. 1, plural wiring patterns 33 are provided on the upper surface 21*a* of the base material 21. The plural wiring patterns 33 are formed by, for example, laser-pattering a nickel thin film formed on the upper surface 21*a* of the base material 21. Each of the plural wiring patterns 33 extends from the rear end of the upper surface 21*a* of the base material 21. One ends of the wiring patterns 33 are respectively connected to the electrodes 31.

The circuit board 14 is mounted on the other end of the wiring pattern 33. The circuit board 14 is, for example, a film carrier package including a film of resin on which plural conductor patterns are formed and an IC connected to the plural conductor patterns. The plural conductor patterns are electrically connected to the other end of the wiring pattern 33.

The frame member 11 is attached to the head body 10 by an adhesive. The lid member 12 is attached to the frame member 11. An ink supply port 41 is provided in the lid member 12. The frame member 11 and the lid member 12 combined with each other close the plural pressure chambers 27 from the side of the upper surface 21*a* of the base material 21.

An ink chamber 42 to which the ink is supplied is provided on the inner side of the frame member 11 and the lid member 12. The lid member 12 is attached to the frame member 11 to close the ink chamber 42. The ink supply port 41 is opened in the ink chamber 42 and connected to an ink tank of the inkjet recording apparatus 1 via a path such as a pipe. The ink chamber 42 communicates with the plural pressure chambers 27. The ink supplied from the ink supply port 41 to the ink chamber 42 is supplied to the plural pressure chambers 27.

The nozzle plate 13 is formed of rectangular film of polyimide. The nozzle plate 13 is not limited to polyimide and may be formed of other materials that can be micro-machined by a laser. The nozzle plate 13 is attached to the head body 10 and the frame member 11. The nozzle plate 13 closes the plural pressure chambers 27 from the side of the front surface 22*b* of the piezoelectric member 22.

As shown in FIG. 2, plural nozzles 45A, 45B, and 45C are provided in the nozzle plate 13. The plural nozzles 45A, 45B, and 45C correspond to the plural pressure chambers 27. The plural nozzles 45A, 45B, and 45C are opened in the plural pressure chambers 27. The diameter of each of the nozzles 45A, 45B, and 45C is, for example, 20 μm.

The plural nozzles 45A, 45B, and 45C are arranged side by side in the longitudinal direction of the nozzle plate 13 in positions shifted from one another. Each of the nozzles 45A is located between the nozzles 45B and 45C. Each of the nozzles 45B is located between the nozzles 45A and 45C. Among the plural nozzles 45A, 45B, and 45C, plural nozzles denoted by the same reference sign eject and not eject the ink at the same timing.

Figure 3:
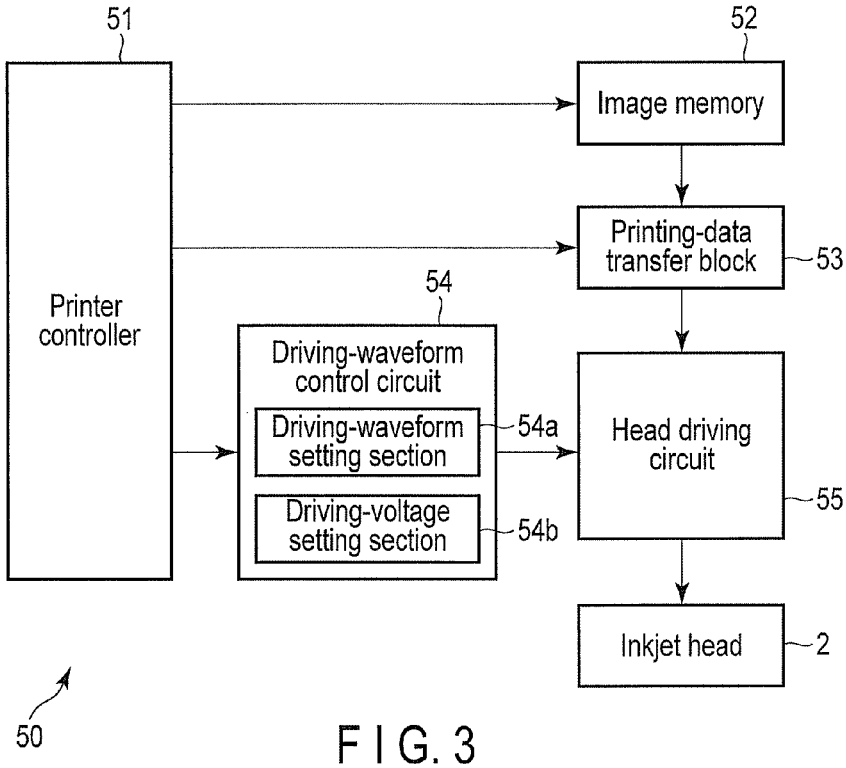
FIG. 3 is a schematic block diagram of the configuration of a control section in the first embodiment.

FIG. 3 is a schematic block diagram of the configuration of a control section 50 that drives the inkjet head 2. The control section 50 includes a printer controller 51, an image memory 52, a printing-data transfer block 53, a driving-waveform control circuit 54, and a head driving circuit 55.

Functions of the printer controller 51, the image memory 52, and the printing-data transfer block 53 are realized by, for example, various components such as a microcomputer provided in the inkjet recording apparatus 1. The driving-waveform control circuit 54 and the head driving circuit 55 are provided on the circuit board 14. Since the circuit board 14 is mounted on the plural electrodes 31, the control section 50 is electrically connected to the plural electrodes 31.

The printer controller 51 stores printing data in the image memory 52. The printer controller 51 controls the printing-data transfer block 53 and transfers the printing data stored in the image memory 52 to the head driving circuit 55. The driving-waveform control circuit 54 includes a driving-waveform setting section 54*a* for setting a driving waveform for driving the head driving circuit 55 and a driving-voltage setting section 54*b* that sets a driving voltage for driving the head driving circuit 55.

The head driving circuit 55 is controlled by the printer controller 51 and the driving-waveform control circuit 54 and outputs a driving signal. In other words, the head driving circuit 55 applies the driving signal to the electrode 31 via the wiring pattern 33.

Processing performed when a driving signal is applied to the electrode 31 corresponding to the nozzle 45A is representatively explained. In the following explanation, the pressure chamber 27 corresponding to the nozzle 45A is referred to as pressure chamber 27A, the electrode 31 provided in the pressure chamber 27A is referred to as electrode 31A, a pairs of column sections 28 forming the side surfaces of the pressure chamber 27A are referred to as column sections 28A.

Figure 4:
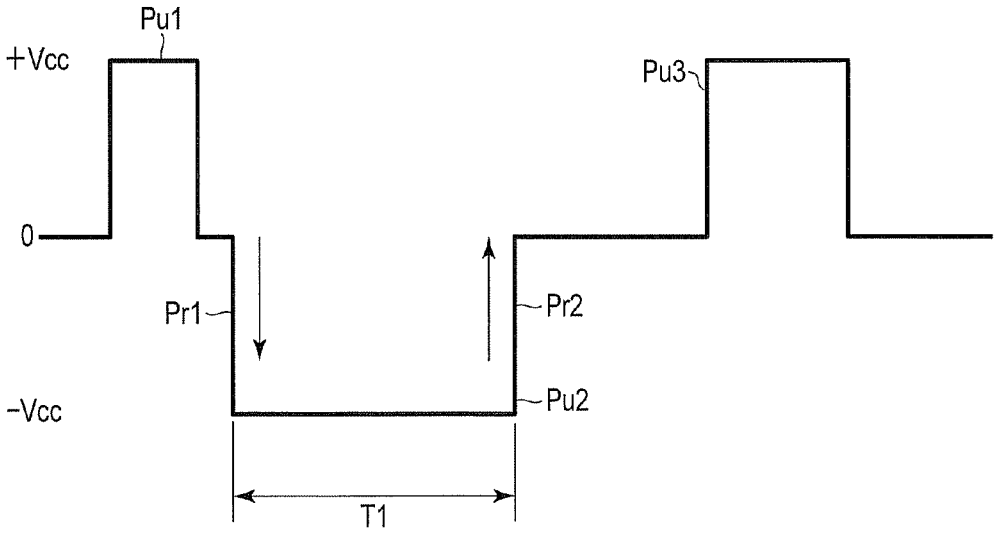
FIG. 4 is a graph of a driving signal for ejecting ink in the first embodiment.

FIG. 4 is a graph of a driving signal for ejecting the ink. As shown in FIG. 4, the head driving circuit 55 applies a boost pulse Pu1, an ejection pulse Pu2, and a damping pulse Pu3 to the electrode 31A provided in the pressure chamber 27A for ejecting the ink.

First, the head driving circuit 55 applies the boost pulse Pu1 to the electrode 31A provided in the pressure chamber 27A for ejecting the ink. The boost pulse Pu1 includes an act of applying a voltage +Vcc and an act of applying a voltage −Vcc. Vcc is, for example, 24 volts.

Figure 5:
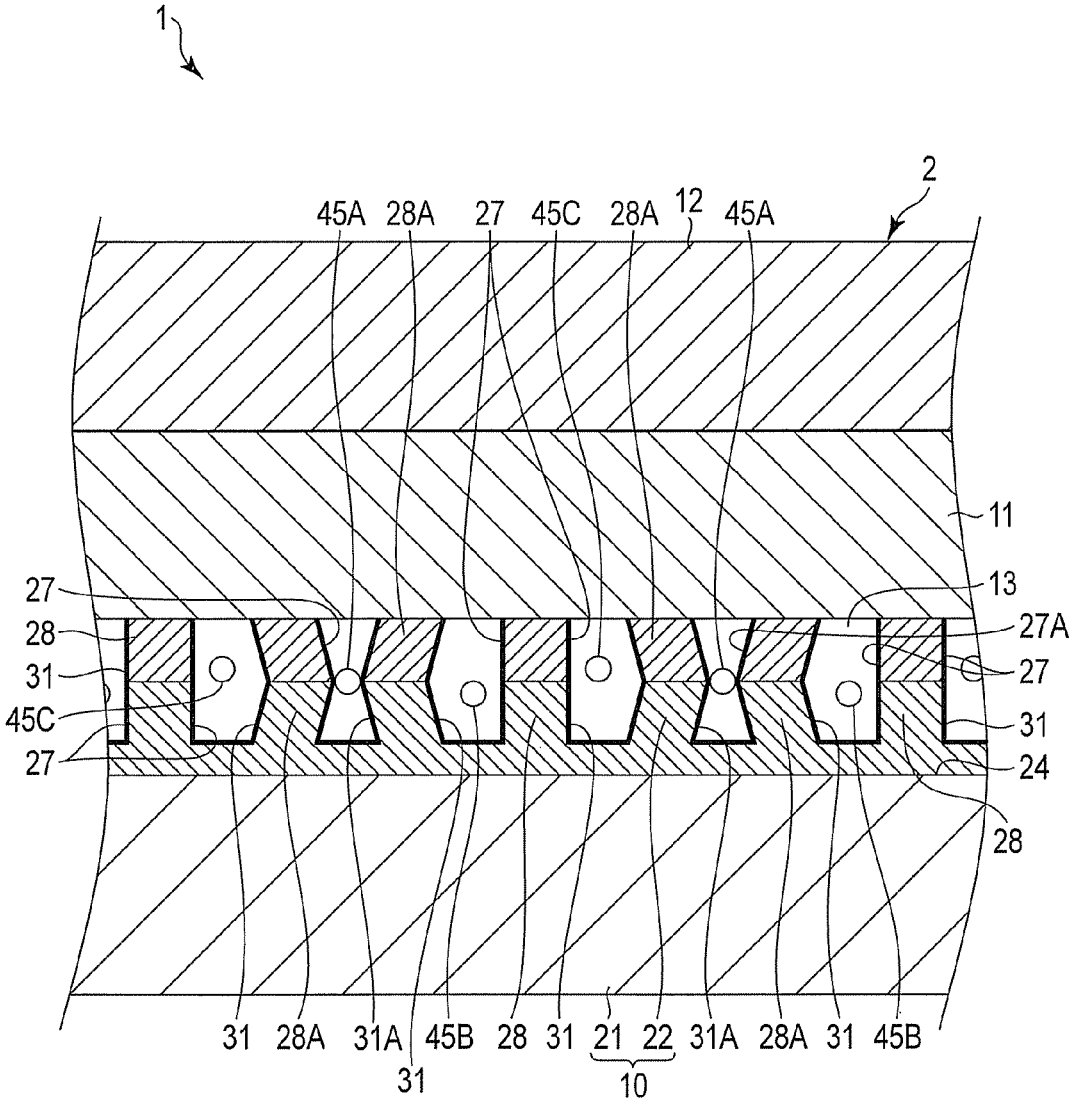
FIG. 5 is a sectional view of the inkjet head, to an electrode of which a positive voltage is applied.

FIG. 5 is a sectional view of a part of the inkjet head 2 in which a positive voltage is applied to the electrode 31A. When the voltage +Vcc is applied to the electrode 31A, the column sections 28A of the piezoelectric member 22 are deformed in the shear mode to reduce the volume of the pressure chamber 27A. When the volume of the pressure chamber 27A decreases, positive pressure is generated in the pressure chamber 27A.

When the voltage −Vcc is applied to the electrode 31A, the column sections 28A of the piezoelectric member 22 deformed in the shear mode return to an original state shown in FIG. 2. Consequently, the volume of the pressure chamber 27A increases and negative pressure is generated in the pressure chamber 27A.

As shown in FIG. 4, after applying the boost pulse Pu1, the head driving circuit 55 applies the ejection pulse Pu2 to the electrode 31A. The ejection pulse Pu2 includes a first voltage change process Pr1 for applying the voltage −Vcc and a second voltage change process Pr2 for applying the voltage +Vcc.

Figure 6:
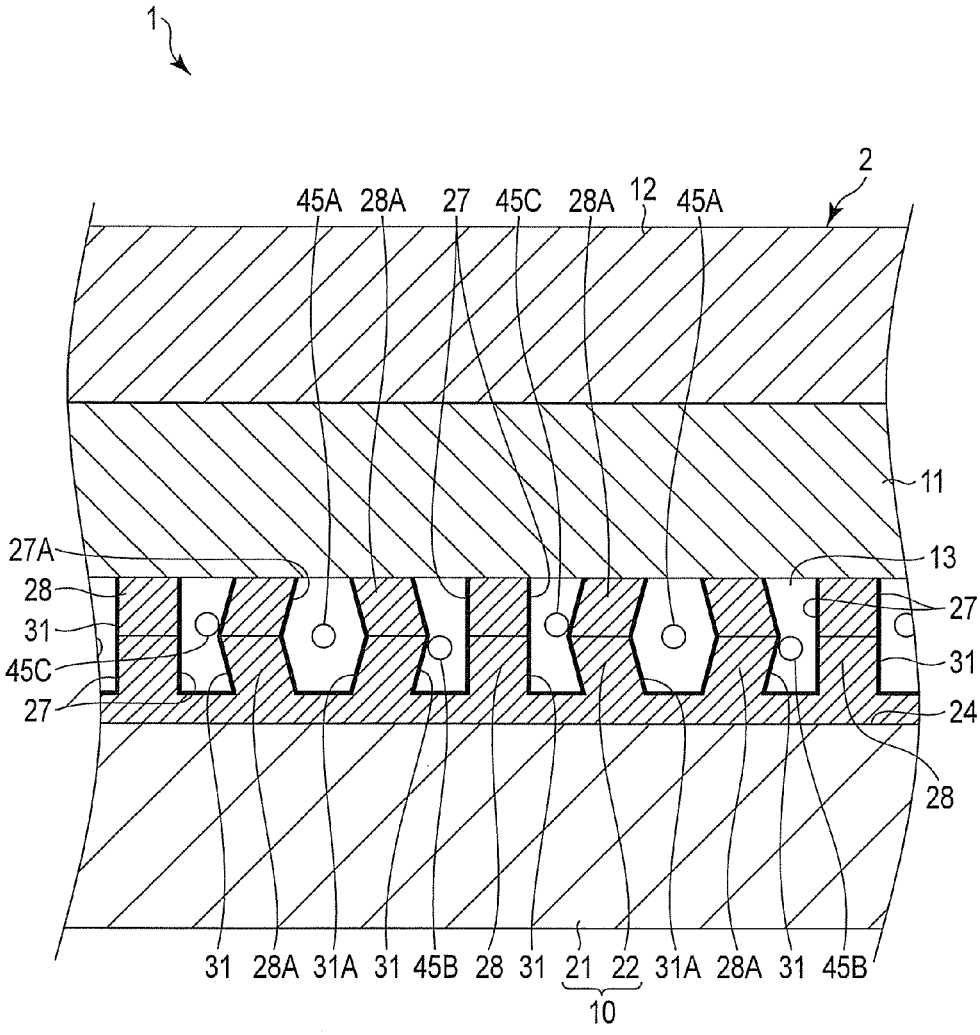
FIG. 6 is a sectional view of the inkjet head, to the electrode of which a negative voltage is applied.

FIG. 6 is a sectional view of a part of the inkjet head 2 in which a negative voltage is applied to the electrode 31A. As shown in FIG. 6, when the voltage −Vcc is applied to the electrode 31A, the column sections 28A of the piezoelectric member 22 are deformed in the shear mode to increase the volume of the pressure chamber 27A. When the volume of the pressure chamber 27A increases, negative pressure is generated in the pressure chamber 27A.

When the voltage +Vcc is applied to the electrodes 31A, the column sections 28A of the piezoelectric member 22 deformed in the shear mode return to the original state shown in FIG. 2. Consequently, the volume of the pressure chamber 27A decreases and positive pressure is generated in the pressure chamber 27A.

In short, in the first voltage change process Pr1, the voltage −Vcc for increasing the volume of the pressure chamber 27A is applied. In the second voltage change process Pr2, the voltage +Vcc for reducing the volume of the pressure chamber 27A is applied.

Width T1 shown in FIG. 4 is time from the first voltage change process Pr1 to the second voltage change process Pr2. The width T1 has length equal to or larger than 0.95 times and equal to or smaller than 1.05 times of a pressure propagation time T in the pressure chamber 27. The pressure propagation time T is time in which a pressure wave is propagated in a distance L from one end to the other end of the pressure chamber 27 shown in FIG. 1. The pressure propagation time T is, for example, 2.0 to 3.0 μs. The pressure propagation time T could change according to, for example, a type of ink in use. In this embodiment, the ink in use is UV ink. The type of ink is not limited to this and may be other types of ink such as solvent ink and oil ink.

As shown in FIG. 4, after applying the ejection pulse Pu2, the head driving circuit 55 applies the damping pulse Pu3 to the electrodes 31A. The damping pulse Pu3 includes a process for applying the voltage +Vcc and a process for applying the voltage −Vcc. According to the damping pulse Pu3, the volume of the pressure chamber 27A decreases and then the pressure chamber 27A returns to the original state.

The ink is ejected as explained below according to the driving signal for ejecting the ink shown in FIG. 4. First, when the boost pulse Pu1 is applied to the electrode 31A, after positive pressure is generated in the pressure chamber 27A, negative pressure is generated. In this state, the ejection pulse Pu2 is applied to the electrode 31A. In the first voltage change process Pr1, negative pressure is further generated in the pressure chamber 27A. Consequently, the ink flows from the ink chamber 42 into the pressure chamber 27A by an amount of the increase in the volume of the pressure chamber 27A.

When the pressure propagation time T elapses, the negative pressure in the pressure chamber 27A changes to positive pressure. Therefore, when the width T1 equal to or larger than 0.95 times and equal to or smaller than 1.05 times of the pressure propagation time T elapses, the pressure in the pressure chamber 27A is the positive pressure. In this state, in the second voltage change process Pr2, positive pressure is further generated in the pressure chamber 27A. Consequently, the pressurized ink is ejected from the nozzle 45A opened in the pressure chamber 27A.

After the ink is ejected, the pressure in the pressure chamber 27A falls. Since the head driving circuit 55 applies the damping pulse Pu3 to the electrode 31A, the ejected ink is prevented from returning to the nozzle 45.

Figure 7:
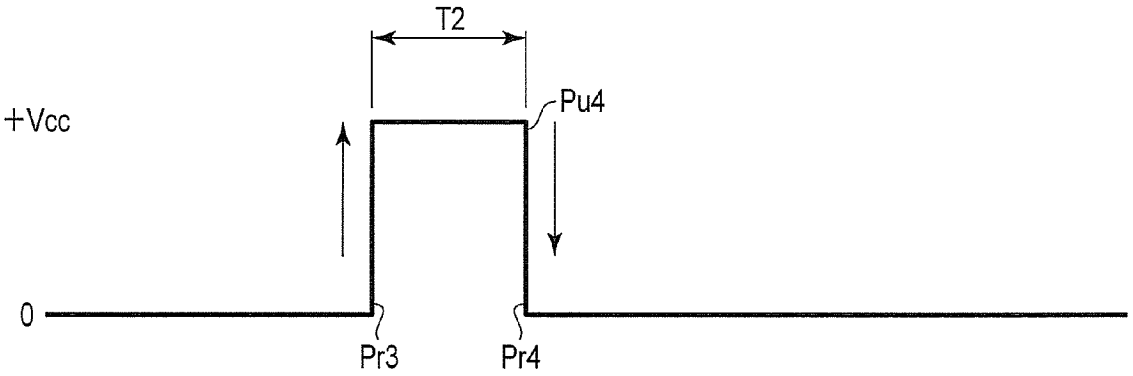
FIG. 7 is a graph of a driving signal for not ejecting the ink.

FIG. 7 is a graph of a driving signal for not ejecting the ink. As shown in FIG. 7, the head driving circuit 55 applies a non-ejection pulse Pu4 to the electrode 31A provided in the pressure chamber 27A for not ejecting the ink.

The non-ejection pulse Pu4 includes a third voltage change process Pr3 for applying the voltage +Vcc for reducing the volume of the pressure chamber 27 and a fourth voltage change process Pr4 for applying the voltage −Vcc for increasing the volume of the pressure chamber 27.

Width T2 shown in FIG. 7 is time from the third voltage change process Pr3 to the fourth voltage change process Pr4. The width T2 is equal to or larger than 0.20 times and equal to or smaller than 0.34 times of the ejection pulse Pu2.

The volume of the pressure chamber 27A, to the electrode 31A corresponding to which the non-ejection pulse Pu4 is applied, is reduced in the third voltage change process Pr3. Subsequently, in the fourth voltage change process Pr4, the volume of the pressure chamber 27A is increased. Consequently, the ink in the pressure chamber 27A is pressurized and depressurized. However, the ink stays in the nozzle 45A opened in the pressure chamber 27A and is not ejected.

Since the ink in the pressure chamber 27A is pressurized and depressurized according to the non-ejection pulse Pu4, the ink is easily ejected when the driving signal for ejecting the ink is applied to the electrode 31A next time. Further, the liquid surface of the ink is prevented from coagulating.

The head driving circuit 55 selectively applies, to each electrode 31A, one of the driving signal for ejecting the ink including the ejection pulse Pu2 and the driving signal for not ejecting the ink including the non-ejection pulse Pu4. Consequently, printing by the inkjet recording apparatus 1 is performed.

Figure 8:
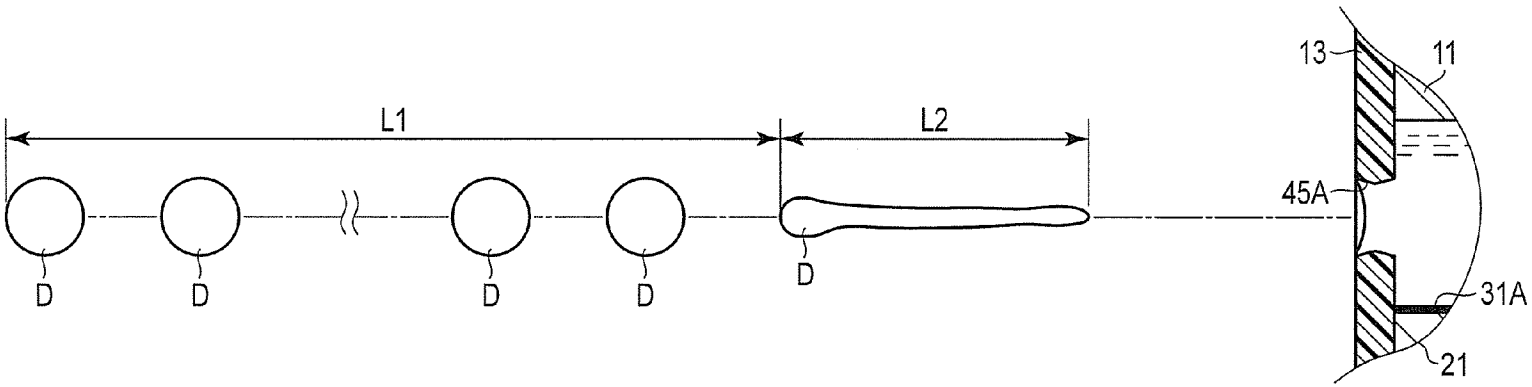
FIG. 8 is a schematic diagram of ink droplets ejected from a nozzle in the first embodiment.

FIG. 8 is a schematic diagram of ink droplets D ejected from the nozzle 45A. As shown in FIG. 8, the inkjet recording apparatus 1 ejects maximum seven ink droplets D from the nozzle 45A. If the inkjet recording apparatus 1 prints a dot of a darkest color such as black on a medium, the inkjet recording apparatus 1 ejects the seven ink droplets D to a predetermined position of the medium. If the inkjet recording apparatus 1 prints a dot of a lightest color such as white, the inkjet recording apparatus 1 does not eject ink droplets to the predetermined position of the medium. If the inkjet recording apparatus 1 prints a dot of a color having intermediate density such as gray, the inkjet recording apparatus 1 ejects one to six ink droplets D to the predetermined position of the medium.

If seven ink droplets D are ejected from the nozzle 45A, the control section 50 applies one boost pulse Pu1, seven ejection pulses Pu2, and seven damping pulses Pu3 to the electrode 31A. If the ink droplets D are not ejected from the nozzle 45A, the control section 50 applies seven non-ejection pulses Pu4 to the electrode 31A. If four ink droplets D are ejected from the nozzle 45A, after applying one boost pulse Pu1, four ejection pulses Pu2, and four damping pulses Pu3 to the electrode 31A, the control section 50 applies three non-ejection pulses Pu4 to the electrode 31A.

As indicated by the ink droplet D on the rightmost side in FIG. 8, the ink droplet D forms a liquid column for a while after being ejected from the nozzle 45A. The ink droplet D changes to a spherical shape with force such as surface tension as the ink droplet D moves further away from the nozzle 45A.

In some case, a part of the liquid column of the ink droplet D separates from the ink droplet D (a main drop). The ink droplet (a satellite drop) separating from the main drop adheres to the medium separately from the main drop. In some case, plural satellite drops separate from one main drop.

Figure 9:
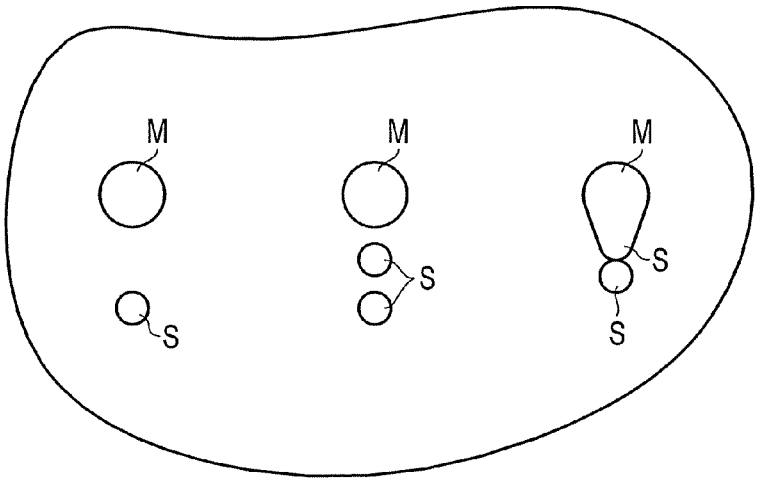
FIG. 9 is a schematic plan view of main dots and plural satellite dots formed on a medium in the first embodiment.

FIG. 9 is a schematic plan view of three main dots M and plural satellite dots S formed on the medium. Each of the main drops adheres to a predetermined position of the medium and forms one main dot M. Plural satellite drops separating from the main drops adhere to the vicinity of the main dot M and form plural satellite dots S. In some case, the satellite dots S overlap or combine with the main dot M.

Length L1 shown in FIG. 8 is a distance from the first ink droplet 0 to the last ink droplet D ejected when 30 to 70 μs elapses after the ink droplets D are ejected from the nozzle 45A. Length L2 is the length of a liquid column formed by the last ink droplet D ejected when 30 to 70 μs elapses after the ink droplets D are ejected from the nozzle 45A. If the width T1 of the ejection pulse Pu2 is equal to or larger than 0.95 times and equal to or smaller than 1.05 times of the pressure propagation time T and the width T2 of the non-ejection pulse Pu4 is equal to or larger than 0.20 times and equal to or smaller than 0.34 times of the width T1, the length L1 is equal to or larger than the length L2. Since the length L1 is equal to or larger than the length L2, the formation of satellite dots is suppressed.

Figure 10:
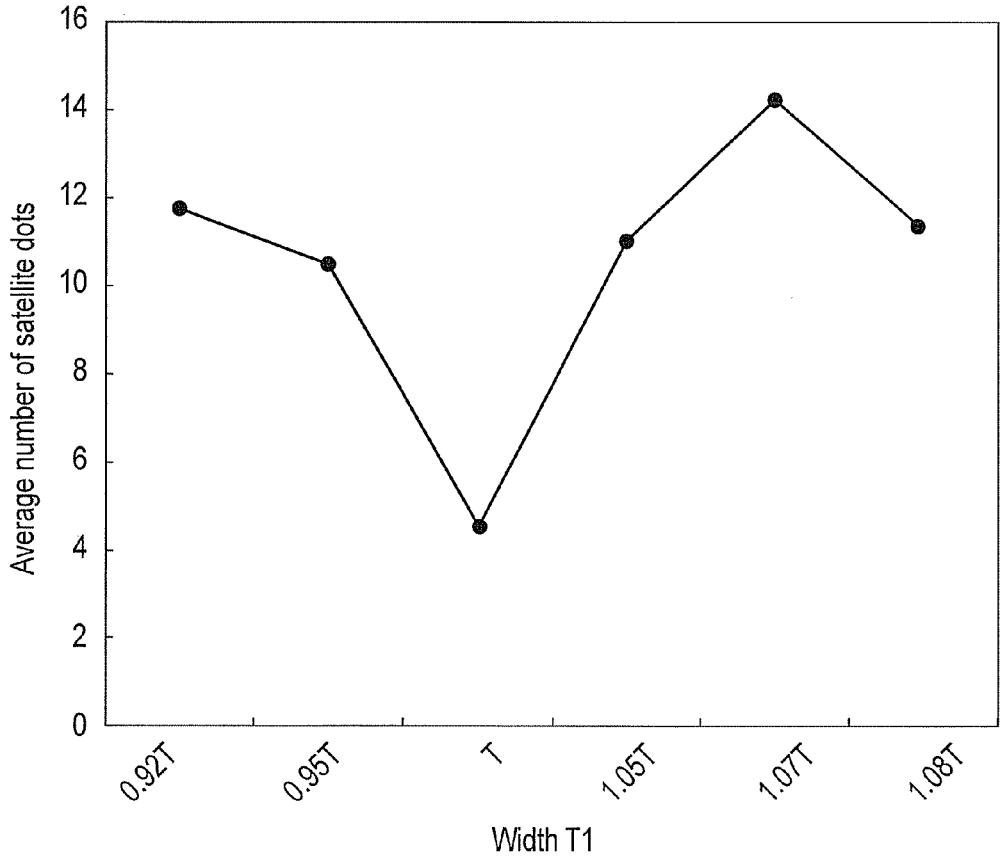
FIG. 10 is a graph of a result obtained by performing an experiment concerning a relation between the width of an ejection pulse and satellite dots in the first embodiment.

FIG. 10 is a graph of a result obtained by performing an experiment concerning a relation between the width T1 of the ejection pulse Pu2 and satellite dots in the inkjet recording apparatus 1 including the configuration explained above. In FIG. 10, the abscissa indicates the length of the width T1 and the ordinate indicates an average of the numbers of satellite dots formed when each of twenty four dots is printed. Each of the dots is printed by ejecting five ink droplets D. In the experiment, the result of which is shown in FIG. 10, the width T2 of the non-ejection pulse Pu4 is set to 0.28 times of the width T1. A distance from the nozzle 45A to the medium is 1.0 mm.

As shown in FIG. 10, it is confirmed that, if the width T1 is equal to or larger than 0.95 times and equal to or smaller than 1.05 times of the pressure propagation time T, the number of formed satellite dots is smaller than the numbers of formed satellite dots in the other cases.

Figure 11:
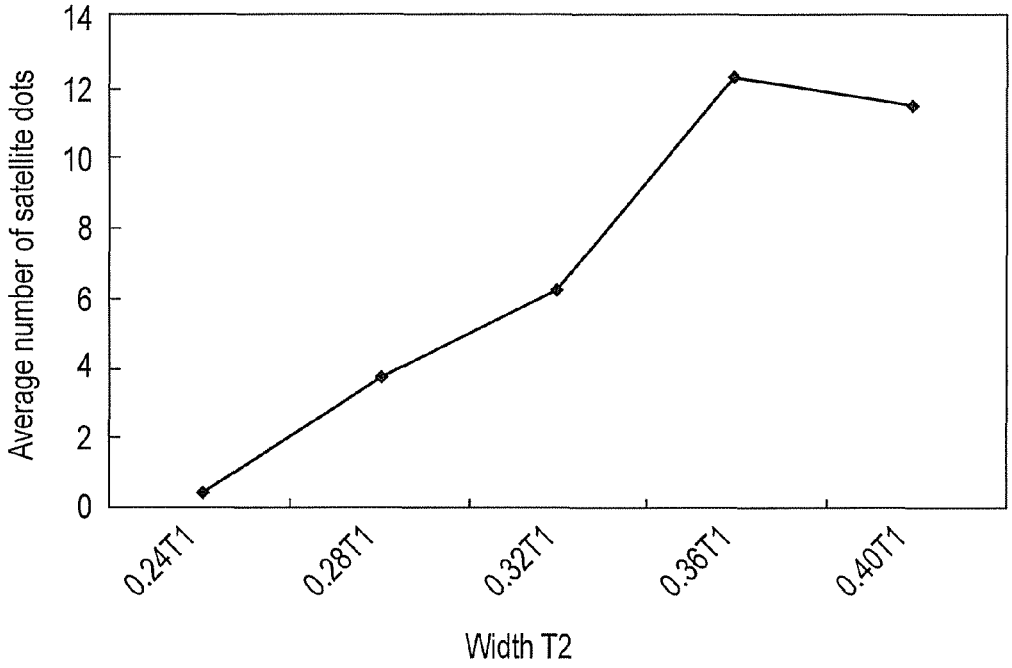
FIG. 11 is a graph of a result obtained by performing an experiment concerning a relation between the width of a non-ejection pulse and satellite dots in the first embodiment.

FIG. 11 is a graph of a result obtained by performing an experiment concerning a relation between the width T2 of the non-ejection pulse Pu4 and satellite dots. In FIG. 11, the abscissa indicates the length of the width T2. In the experiment, the result of which is shown in FIG. 11, the width T1 of the ejection pulse Pu2 is set to be equal to the pressure propagation time T.

As shown in FIG. 11, it is confirmed that, if the width T2 is smaller than 0.34 times of the width T1 of the ejection pulse Pu2, the number of formed satellite dots decreases. However, if the width T2 is smaller than 0.20 times of the width T1, the non-ejection pulse Pu4 could not play the function thereof. In other words, when the driving signal for ejecting the ink is applied to the electrode 31A next time, the ink is not easily ejected.

From the results of the experiment, it is confirmed that the formation of satellite dots is suppressed if the width T1 is equal to or larger than 0.95 times and equal to or smaller than 1.05 times of the pressure propagation time T and the width T2 is equal to or larger than 0.20 times and equal to or smaller than 0.34 times of the width T1.

An inkjet recording apparatus according to a second embodiment is explained below with reference to FIG. 12. In the second embodiment, components having functions same as those of the inkjet recording apparatus 1 according to the first embodiment are denoted by the same reference numerals and signs. A part or all of explanation of the components is sometimes omitted.

Figure 12:
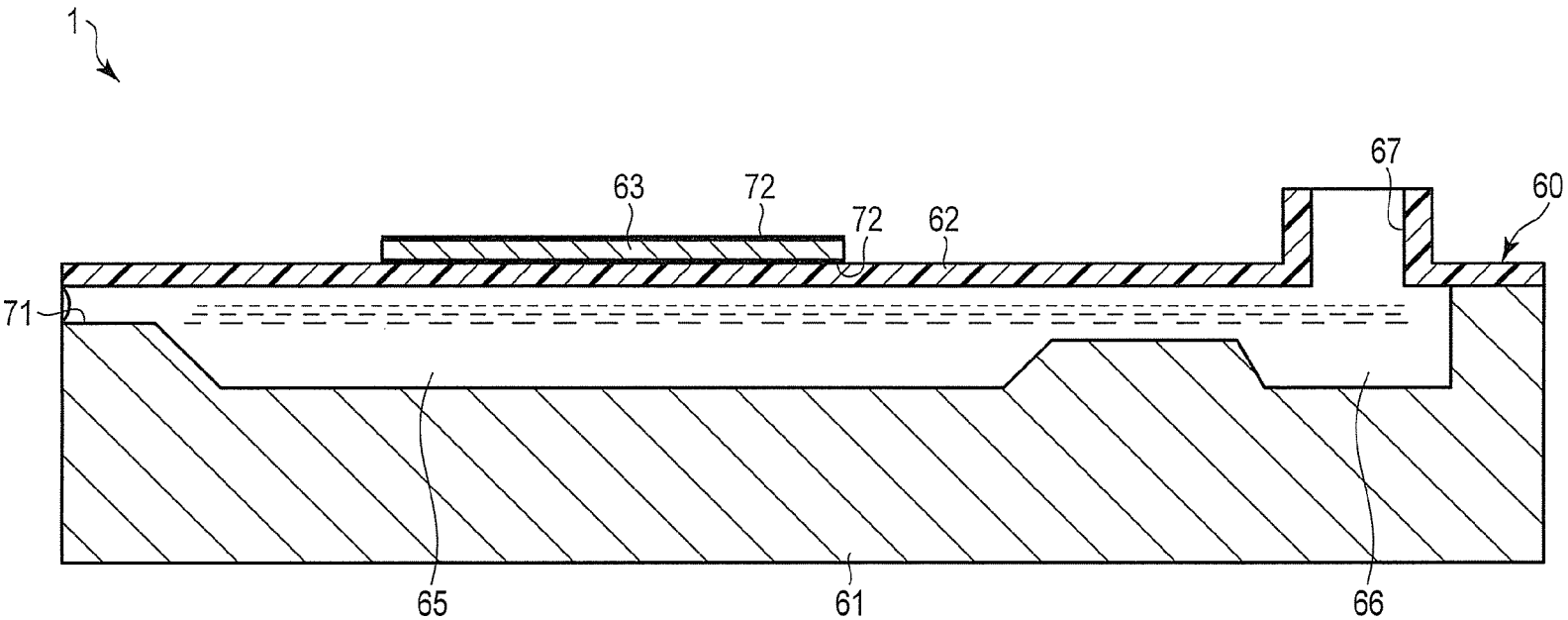
FIG. 12 is a sectional view of an inkjet head according to a second embodiment.

FIG. 12 is a sectional view of an inkjet head 60 according to the second embodiment. The inkjet head 60 according to the second embodiment is an inkjet head of a so-called Kayser type. The inkjet head 60 includes a base material 61, an elastic plate 62, and a piezoelectric member 63.

The base material 61 includes plural pressure chambers 65 and an ink chamber 66. The plural pressure chambers 65 are formed in a groove shape and arranged in parallel to one another. The ink chamber 66 communicates with each of the plural pressure chambers 65.

The elastic plate 62 is attached to the base material 61. The elastic plate 62 is a tabular member having flexibility. The elastic plate 62 closes the plural pressure chambers 65 and the ink chamber 66. Consequently, the elastic plate 62 forms the upper surface of the pressure chamber 65. The elastic plate 62 includes an ink supply port 67 opened in the ink chamber 66. The ink supply port 67 is connected to an ink tank of the inkjet recording apparatus 1 via a path such as a pipe.

The elastic plate 62 is attached to the base material 61 to form plural nozzles 71. The plural nozzles 71 are respectively opened in the plural pressure chambers 65.

The piezoelectric member 63 is attached to the elastic plate 62 formed in a tabular shape. Electrodes 72 are respectively provided on both the surfaces of the piezoelectric member 63. The electrodes 72 are electrically connected to the head driving circuit 55 of the control section 50.

When a voltage is applied from the head driving circuit 55 to the electrodes 72, the piezoelectric member 63 bends. Since the piezoelectric member 63 is attached to the elastic plate 62, the bent piezoelectric member 63 deflects the elastic plate 62.

For example, when the voltage +Vcc is applied to the electrodes 72, the piezoelectric member 63 deflects the elastic plate 62 to reduce the volume of the pressure chamber 65. When the voltage −Vcc is applied to the electrodes 72, the piezoelectric member 63 deflects the elastic plate 62 to increase the volume of the pressure chamber 65.

When the inkjet head 60 of the Kayser type explained above is used, formation of satellite dots is suppressed by setting the width T1 of the ejection pulse Pu2 to be equal to or larger than 0.95 times and equal to or smaller than 1.05 times of the pressure propagation time T and setting the width T2 of the non-ejection pulse Pu4 to be equal to or larger than 0.20 times and equal to or smaller than 0.34 times of the width T1.

With the inkjet recording apparatus according to at least one of the embodiments explained above, the width of the ejection pulse that ejects the ink is equal to or larger than 0.95 times and equal to or smaller than 1.05 times of the pressure propagation time and the width of the non-ejection pulse that stops the ink is equal to or larger than 0.2 times and equal to or smaller than 0.34 times of the ejection pulse width. Consequently, formation of satellite dots is suppressed.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An inkjet recording apparatus comprising:

a head body including plural pressure chambers to which ink is supplied and a piezoelectric member that is deformed according to an applied voltage to change volume of each of the plural pressure chambers;

plural electrodes provided in the piezoelectric member to respectively correspond to the plural pressure chambers;

a nozzle plate arranged to close the plural pressure chambers, plural nozzles respectively opened in the plural pressure chambers being provided in the nozzle plate; and a control section electrically connected to the plural electrodes, the control section applying, to the electrode corresponding to each of the pressure chambers, an ejection pulse that includes a first voltage change process for applying a voltage for increasing the volume of the pressure chamber and a second voltage change process for applying a voltage for reducing the volume of the pressure chamber, has width equal to or larger than 0.95 times and equal to or smaller than 1.05 times of a pressure propagation time in the pressure chamber, and ejects the ink from the nozzle, or a non-ejection pulse that has width equal to or larger than 0.2 times and equal to or smaller than 0.34 times of the width of the ejection pulse and stops the ink in the nozzle in order to suppress formation of satellite dots.

2. The apparatus of claim 1, wherein the non-ejection pulse includes a third, voltage change process for applying the voltage for reducing the volume of the pressure chamber and a fourth voltage change process for applying the voltage for increasing the volume of the pressure chamber.

3. The apparatus of claim 2, wherein the plural pressure chambers are formed by plural grooves provided in the piezoelectric member.

4. The apparatus of claim 2, wherein the head body includes an elastic plate that forms a part of the plural pressure chambers, and the piezoelectric member is attached to the elastic plate and changes the volume of each of the plural pressure chambers by deflecting the elastic plate according to the applied voltage.

5. The apparatus of claim 3, wherein the plural nozzles are arranged side by side on the nozzle plate in positions shifted from one another.

6. An inkjet recording method for an inkjet apparatus including:

a head body including plural pressure chambers to which ink is supplied and a piezoelectric member that is deformed according to an applied voltage to change volume of each of the plural pressure chambers;

plural electrodes provided in the piezoelectric member to respectively correspond to the plural pressure chambers;

a nozzle plate arranged to close the plural pressure chambers, plural nozzles respectively opened in the plural pressure chambers being provided in the nozzle plate; and a control section electrically connected to the plural electrodes, the inkjet recording method comprising:

causing the control section to apply, to the electrode corresponding to the pressure chamber for ejecting the ink, an ejection pulse that includes a first voltage change process for applying a voltage for increasing the volume of the pressure chamber and a second voltage change process for applying a voltage for reducing the volume of the pressure chamber, has width equal to or larger than 0.95 times and equal to or smaller than 1.05 times of a pressure propagation time in the pressure chamber and to apply, to the electrode corresponding to the pressure chamber for not ejecting the ink, a non-ejection pulse that has width equal to or larger than 0.2 times and equal to or smaller than 0.34 times of the width of the ejection pulse in order to suppress formation of satellite dots.

7. The method of claim 6, wherein the non-ejection pulse includes a third voltage change process for applying the voltage for reducing the volume of the pressure chamber and a fourth voltage change process for applying the voltage for increasing the volume of the pressure chamber.

8. The method of claim 7, wherein the plural pressure chambers are formed by plural grooves provided in the piezoelectric member.

9. The method of claim 7, wherein the head body includes an elastic plate that forms a part of the plural pressure chambers, and the piezoelectric member is attached to the elastic plate and changes the volume of each of the plural pressure chambers by deflecting the elastic plate according to the applied voltage.

10. The method of claim 8, wherein the plural nozzles are arranged side by side on the nozzle plate in positions shifted from one another.

11. An inkjet recording apparatus comprising:

a head body including plural pressure chambers to which ink is supplied and a piezoelectric member that is deformed according to an applied voltage to change volume of each of the plural pressure chambers, plural nozzles respectively opened in the plural pressure chambers being provided in the head body;

plural electrodes provided in the piezoelectric member to respectively correspond to the plural pressure chambers; and a control section electrically connected to the plural electrodes, the control section applying, to the electrode corresponding to each of the pressure chambers, an ejection pulse that has width equal to or larger than 0.95 times and equal to or smaller than 1.05 times of a pressure propagation time in the pressure chamber and ejects the ink from the nozzle, or a non-ejection pulse that has width equal to or larger than 0.2 times and equal to or smaller than 0.34 times of the width of the ejection pulse and stops the ink in the nozzle in order to suppress formation of satellite dots.

12. The apparatus of claim 11, wherein the plural pressure chambers are formed by plural grooves provided in the piezoelectric member.

13. The apparatus of claim 11, wherein the head body includes an elastic plate that forms a part of the plural pressure chambers, and the piezoelectric member is attached to the elastic plate and changes the volume of each of the plural pressure chambers by deflecting the elastic plate according to the applied voltage.

14. The apparatus of claim 12, wherein the plural nozzles are arranged side by side in positions shifted from one another.

* * * * *